United States Patent [19]

Buttermann

[11] Patent Number: 4,676,449

[45] Date of Patent: Jun. 30, 1987

[54] APPARATUS FOR ACCURATELY POSITIONING AND FIXING A LOOM BEAM

[75] Inventor: Günter Buttermann, Nettetal, Fed. Rep. of Germany

[73] Assignee: Hacoba Textilmaschinen GmbH & Co KG, Wuppertal, Fed. Rep. of Germany

[21] Appl. No.: 783,891

[22] Filed: Oct. 3, 1985

[30] Foreign Application Priority Data

Oct. 3, 1984 [DE] Fed. Rep. of Germany ..... 3436186

[51] Int. Cl.[4] ..... B65H 25/02; B65H 19/02; D02H 3/00

[52] U.S. Cl. ..... 242/68.4; 242/65; 242/18 DD; 242/25 R; 242/54.4

[58] Field of Search ..... 242/18 DD, 25 R, 54.4, 242/58.6, 67.1 R, 68.4, 75.2, 129.51, 65

[56] References Cited

U.S. PATENT DOCUMENTS 2,800,288 7/1957 Bandy ..... 242/68.4

FOREIGN PATENT DOCUMENTS 2628788 3/1978 Fed. Rep. of Germany ..... 242/68.4
2725176 12/1978 Fed. Rep. of Germany ..... 242/68.4

*Primary Examiner*—Stuart S. Levy
*Assistant Examiner*—David Werner
*Attorney, Agent, or Firm*—Karl F. Ross; Herbert Dubno

[57] ABSTRACT

A process and apparatus for accurately positioning and fixing a loom beam provided with side flanges for winding threads or fabric webs includes a pair of proximity switches which after the loom beam is brought into a prealigned position are positioned between the side flanges to determine the position of the loom beam and if necessary cause an adjustment thereof. The proximity switches are exactly symmetrically aligned with respect to a reference line that is the central line of a pressing cylinder which is provided to smooth the wound fabric webs or threads and extends between the side flanges. In case the proximity switches have different distances to the facing side flanges, the loom beam is realigned until the difference between the distances is compensated.

9 Claims, 5 Drawing Figures

$a_1 \neq a_2$
$u_2 \neq u_3$
$u_2 = u_3$
$a_1 = a_2$
6
7
4
5
2
2'
3
3'
55
1
10
17
11
12
54
12'
11'
11"
18
10'
10"
53
$u_2$
$u_3$
15
16
2
1'
3
9
13
8
14
c

APPARATUS FOR ACCURATELY POSITIONING AND FIXING A LOOM BEAM

FIELD OF THE INVENTION

My present invention relates to and to an apparatus for accurately positioning and fixing a loom beam in a machine, e.g. a beam warping machine for winding fabric webs or a plurality of threads.

BACKGROUND OF THE INVENTION

From the German publication DE-OS No. 26 28 788 a method for fixing a loom beam is known in which the loom beam is supported and clamped in position by two bearing shafts.

The loom beam includes two parallel and spaced beam or side flanges (lateral flanges, disks or cheeks) which are respectively engaged by the bearing shafts when the loom beam is in the supported position.

The bearing shafts are actuated by respective adjusting drives which are controlled by limit switches after aligning the loom beam with respect to a pressing drum. When the loom beam is in the aligned position, the pressing drum, roller or drum is moved so as to be positioned between the side flanges for providing a smoothing of the coiled turns.

Although this method seems to be sound with respect to a central alignment of the loom beam relative to the pressing drum, it does not take into consideration the manufacturing tolerances of the side flanges and other parts of the loom beam. These manufacturing tolerances are of relevant magnitude and arise between the inner surfaces of the plates and the outer surface thereof against which the bearing shafts act. Thus, the central alignment of the loom beam fluctuates by this tolerance so that the pressing drum must be shortened at least by this tolerance at each side in order to avoid a contact thereof with the side flanges.

In practice, this had led to shortening of the pressing drum at each side by, e.g. 8 mm so that the coiled material was not contacted by the pressing drum along a length of $2\times 8$ mm. Consequently, this area could not be smoothed by the pressing drum resulting in defects when producing a weaver's beam as the smoothed threads are differently arranged than the unfinished threads and also have different characteristics, e.g. better reeling off qualities.

OBJECT OF THE INVENTION

It is thus the principal object of my present invention to provide an improved apparatus for accurately positioning and fixing a loom beam obviating the aforestated drawbacks and thus allowing a smoothing of the coiled material along its entire width.

SUMMARY OF THE INVENTION

I realize this object by providing a pair of proximity switches which are centrally aligned with respect to the pressing drum and movable between the side flanges of the loom beam to determine the distance thereof to the respective side flanges. In dependence on that determination, the loom beam is adjusted so the inner surfaces of the side flanges are equidistant to the ends of the pressing drum when the latter is positioned between these flanges.

Through the provision of such proximity switches, the inner surfaces of the side flanges are accurately aligned with respect to the central line of the pressing drum as the manufacturing tolerances of the side flanges have now been taken into account. In case the proximity switches determine that the loom beam after being raised into the clamping position and prealigned by the bearing shafts is not in effect accurately aligned, a readjustment of the loom beam is obtained via at least one of the adjusting drives whereby the respective limit switch is put out of operation. Consequently, the pressing drum can be dimensioned to have a considerably greater length. I have found it to be sufficient if the pressing drum is shorter by about 1 to 2 mm than the distance between the inner surfaces of the side flanges. This difference of 1 to 2 mm does not have any negative effect on the uniformity of warp thread coiling.

The proximity switches have each an active area which extends parallel to the inner surface of the side flanges when being positioned between the latter. In this position of the proximity switches, the generated potential between the active areas and the flanges is determined which potential depends on the distance of this active area from the opposing side flanges. The measured potentials are transmitted to a comparator which communicates with at least one of the adjusting drives via a three-point controller (e.g. a proportional controller, a proportional-integral controller or a porportional-integral-differential controller) in case the potential difference as measured by the proximity switches exceeds a threshold value as stored in the controller.

BRIEF DESCRIPTION OF THE DRAWING

The above and other objects, features and advantages of my present invention will now be described in more detail with reference to the accompanying drawing, in which.

SPECIFIC DESCRIPTION

Figure 5:
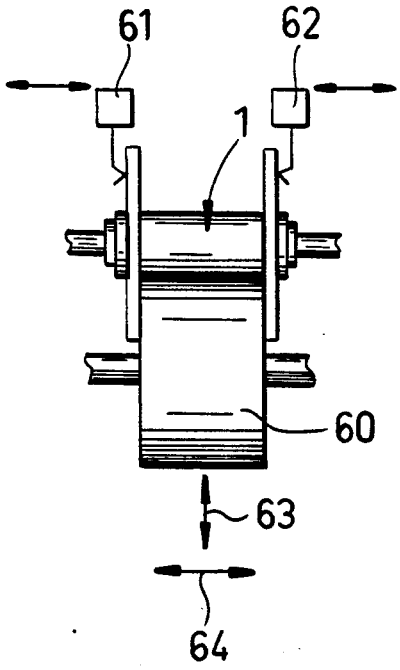
FIG. 5 is a detail elevation of a part of the apparatus.

In the drawing, I have shown a loom beam 1 which is to be positioned in a machine, e.g. a warping machine, to wind threads or fabric webs. The loom beam 1 includes two beam or side flanges 10 which are arranged parallel at a distance to each other and are connected by an axle 1'. The loom beam 11 which is of considerable weight is elevated by a motor-driven hoisting device (not shown) from an initial position at the ground to a clamping position in which a pressing drum 60 (FIG. 5) extends within the side flange 10 to smooth the wound threads or fabric webs during rotation of the loom beam 1.

As will be explained hereinbelow, the loom beam 1 is positioned in such a manner that the end faces of the pressing drum are equidistant to the opposing side flanges 10 so that a complete smoothing of the threads or fabric webs along its entire width is obtained.

In the elevated or clamping position, the loom beam 1 is held by a pair of bearing shafts 11, 12 which are pivoted in respective machine frames 55 and are engageable in the side flanges 10. Each bearing shaft 11, 12 extends perpendicularly to the side flanges 10 and is provided with a truncated cone-shaped piece 18 at its extremity facing the respective side flange 10. These truncated cone-shaped pieces 18 engage into a recess 17 provided at each end section of the axle 1' so that a secure connection is provided between the bearing shafts 11, 12 and the loom beam 1 when the latter is in the clamping position and the hoisting device is lowered again.

The bearing shafts 11, 12 are actuated by respective adjusting drives 11', 12' which are controlled by limit switches. The adjusting drive 11' is constituted by a piston-cylinder drive whose piston 1'' is connected to the bearing shaft 11 while the adjusting drive 12' is an electromotor rotating a threaded rod 54 which extends into a threaded bush 53 and acts upon the bearing shaft 12 to allow axial adjustment of the latter and of the respective truncated cone-shaped piece 18. I may note that the clamping of the loom beam 1 in this manner is known per se and described, e.g. in the German publication DE-OS No. 26 28 788.

As is shown in the drawing, the loom beam 1 further cooperates with a pair of identical proximity switches 2, 3 which are arranged above the loom beam 1 and extend perpendicularly to the axle 1'. The proximity switches 2, 3 are exactly symmetrically positioned with respect to the center c of the machine (and of the pressing drum), i.e. they have the same distance to the center c, and are movable towards the loom beam 1 so as to be arranged between the opposing side flanges 10. The motion of the switches 2, 3 in direction perpendicular to the axle 1' is provided by a pair of piston-cylinder drives 6, 7 whose piston rods 4, 5 are connected to the respective proximity switches 2, 3. The actuation of the drives 6, 7 is provided via pneumatic or hydraulic means or also by purely mechanical means via adjusting motors and rack guidances. In order to provide a compact design, the motion path of the proximity switches 2, 3 is parallel to the movement of the pressing drum 60 (arrows 63 and 64). The drum 60 may, for example, be movable in longitudinal direction, the proximity switches 2, 3 being displaceable parallel thereto.

Each proximity switch 2, 3 is equipped with an active area 2', 3' which extends parallel to the inner surface 10', 10'' of the side flanges 10 when the switches 2, 3 are located between the side flanges 10. When lowering the switches 2, 3 into the position as shown in FIG. 2, the active areas 2', 3' face the inner surfaces 10', 10'' so that a potential $U_2$, $U_3$ is obtained whose magnitude depends on the distance between the inner surfaces 10', 10'' and the active areas 2', 3' and increases linearly with increasing distances therebetween.

The measured values of the potential $U_2$, $U_3$ are transmitted via lines 8, 9 to a comparator 13 which communicates with the adjusting drive 12' via a three-step controller 14. In case the difference between the measured potentials $U_2$, $U_3$ exceed a predetermined threshold value as stored in the three-step controller 14, the adjusting drive 12' is actuated to shift the bearing shaft 12 and thus the loom beam 1 in axial direction thereof to accurately align the inner surfaces 10', 10'' of the side flanges 10 with respect to the center c of the machine and thus of the pressing drum.

FIGS. 1 to 4 illustrate schematically the individual steps to align the loom beam 1 exactly with respect to the center c of, e.g. a beam warping machine.

Figures 1, 2, 3, 4:
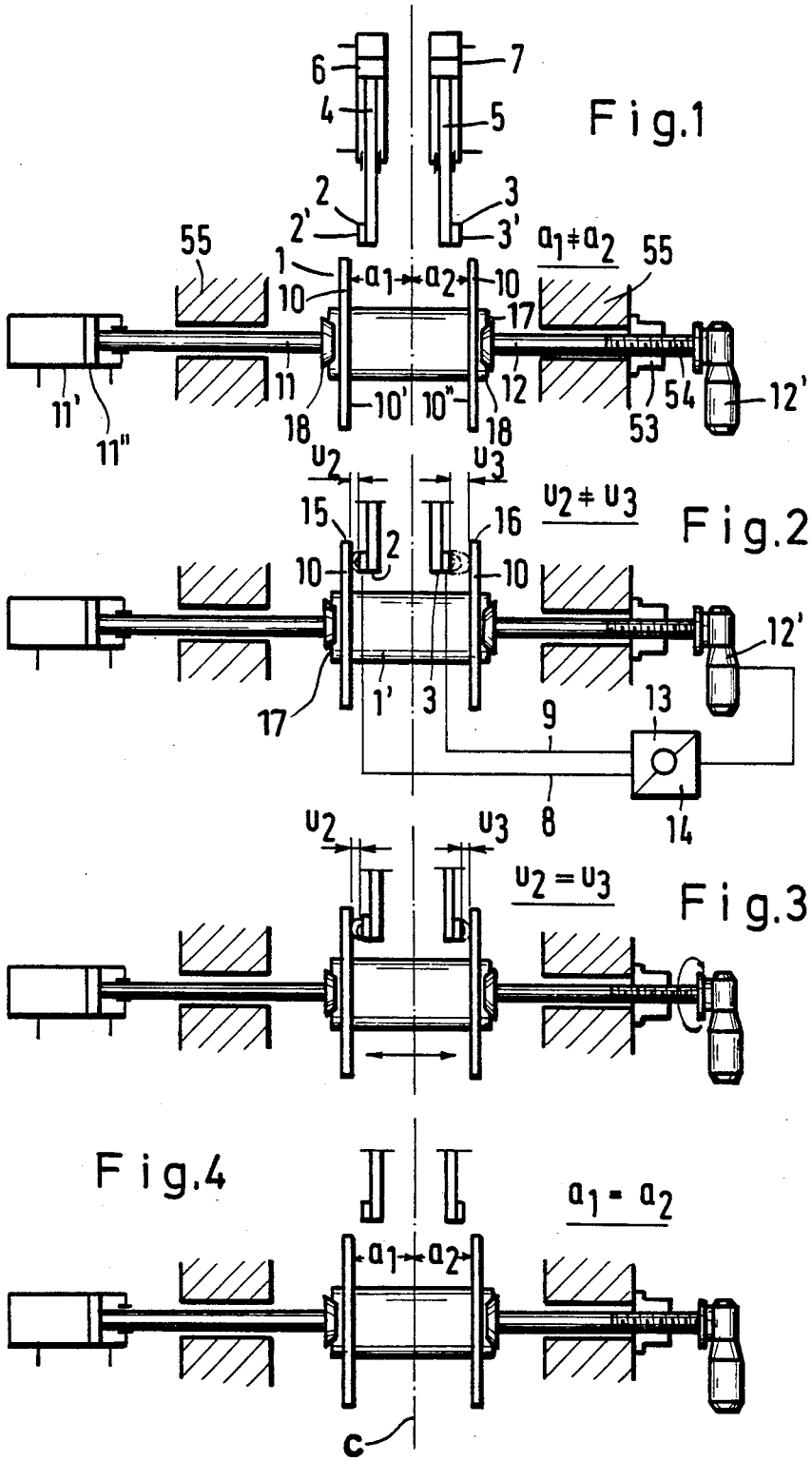
FIGS. 1 to 4 show four succeeding steps of a method according to the invention for accurately aligning a loom beam with respect to a central reference line.

As indicated in FIG. 1, the loom beam 1 is elevated into its upper position in which it is prealigned and fixed by the bearing shafts 11, 12 with respect to the center c. The proximity switches 2, 3 are positioned in their elevated position, i.e. beyond the area between the side flanges 10. The distance between the inner surfaces 10', 10'' from the center c is indicated by $a_1$ and $a_2$, and it may be seen that in FIG. 1 the distances $a_1$ and $a_2$ are not equal because of, e.g. previously mentioned manufacturing tolerances of the side flanges 10.

After prealigning the loom beam 1 with the bearing shafts 11, 12, the proximity switches 2, 3 are lowered by the piston rods 4, 5 until facing the side flanges 10. In order to avoid measuring errors, the proximity switches 2, 3 extend during measurement with a distance to the axle 1' as well as to the upper edges 15, 16 of the side flanges 10. Depending on the distance of the active areas 2', 3' to the inner surfaces 10', 10'', corresponding potentials $U_2$, $U_3$ are obtained which in the present case are different as the distance $a_1$ is different from the distance $a_2$. These potentials $U_2$, $U_3$ are transmitted to the comparator 13 in which the difference between the potentials is determined and compared with a threshold value in the three-step controller 14. In the present example, the difference exceeds the threshold value so that the three-point controller 14 is actuated to cause the bearing shaft 12 via adjusting drive 12' to move the loom beam 1 towards the left (as $U_3 > U_2$) until the difference of the potentials is compensated and $U_2$ is equal to $U_3$, as indicated in FIG. 3. Consequently, the inner surfaces 10', 10'' of the side flanges 10 are now equidistant to the proximity switches 2, 3 so that $a_1 = a_2$.

Thereafter, the proximity switches 2, 3 are retracted as shown in FIG. 4 and the loom beam 1 is exactly aligned with respect to the center c.

I may note that for security reasons, it is advisable to have the adjusting drive 11' continuously in operation even after fixing and alignment of the loom beam 1 by the adjusting drives 11', 12' has been obtained. However, in order to prevent an axial displacement of the loom beam 1 solely by the adjusting drive 11', the adjusting drive 12' is so designed that the threaded rod 54 forms with the threaded bushing 53 a back locking due to the self-locking thread. On the other hand, the adjusting drive 12' is provided with an adjusting force which is higher than the adjusting force of the device 11' so that the loom beam 1 is displaceable against the force of the adjusting drive 11' in either direction.

This is also true in case the loom beam 1 is readjusted via the proximity switches 2, 3 in the described manner.

In this connection, I should also mention that during the described central alignment of the loom beams 1, the limit switches 61, 62 of the adjusting drives are put out of operation which are required to align the loom beam 1 after clamping the latter.

I claim:

1. An apparatus for accurately positioning and fixing a loom beam with respect to a pressing cylinder for winding and smoothing fabric webs or a plurality of threads, the loom beam having two spaced and parallel side flanges, said apparatus comprising:

sensing means for determining the position of the loom beam with respect to the center line of the pressing cylinder by measuring the distance of said sensing means to the side flanges; and control means for adjusting the position of the loom beam with respect to the center line of the pressing cylinder in dependence on the measurement provided by said sensing means, said sensing means including a pair of proximity switches symmetrically aligned with respect to the center line of the pressing cylinder and movable between the side flanges, said proximity switches measuring the potential between each of said proximity switches and the respectively facing side flanges to determine the distance of the proximity switches from the side flanges.

2. An apparatus as defined in claim 1 wherein said control means includes a comparator communicating with said proximity switches and a three-step controller operatively connected to said comparator and including a threshold value, said comparator determining the difference of the potential as generated between the proximity switches and the side flanges to provide an actual value which when exceeding the threshold value causes said three-step controller to adjust the position of the loom beam until accurately aligned with respect to the central line.

3. An apparatus as defined in claim 2, and further comprising electromotive driving means for adjusting the loom beam in dependence on the determination by said comparator, said proximity switches communicating with said driving means via said comparator and said three-step controller.

4. An apparatus as defined in claim 1 wherein the pressing cylinder is movable in direction of its center line towards the loom beam, said proximity switches being movable parallel to the moving direction of the pressing cylinder.

5. An apparatus as defined in claim 1 wherein each of said proximity switches is provided with an active area which faces the side flanges when being positioned therebetween, said proximity switches providing a potential linearly increasing with increasing distance of said active areas from the side flanges.

6. An apparatus as defined in claim 1 wherein said loom beam includes an axle connecting the said flanges, said proximity switches being arranged at a distance to the axle when being positioned between the side flanges.

7. An apparatus as defined in claim 1 wherein the side flanges have an upper circumferential edges, said proximity switches being arranged at a distance to the upper circumferential edge of each side flange when being positioned therebetween.

8. An apparatus as defined in claim 1 and further comprising driving means for moving said proximity switches between a first position in which said proximity switches are positioned beyond the loom beam and a second position in which said proximity switches are positioned between the side flanges.

9. An apparatus as defined in claim 8 wherein said driving means includes for each of said proximity switches a piston-cylinder device whose piston rod is connected to the respective proximity switch.

* * * * *